US008641553B2

(12) United States Patent
Gill et al.

(10) Patent No.: US 8,641,553 B2
(45) Date of Patent: Feb. 4, 2014

(54) FLEXIBLE GOLF CLUB GRIP

(71) Applicants: David Keith Gill, Augusta, MI (US); Bruce Allan Miller, Pinehurst, NC (US); Daniel Francis Koehler, Plymouth, MN (US)

(72) Inventors: David Keith Gill, Augusta, MI (US); Bruce Allan Miller, Pinehurst, NC (US); Daniel Francis Koehler, Plymouth, MN (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/862,636

(22) Filed: Apr. 15, 2013

(65) Prior Publication Data

US 2013/0231200 A1 Sep. 5, 2013

Related U.S. Application Data

(63) Continuation of application No. 13/246,100, filed on Sep. 27, 2011, now abandoned.

(51) Int. Cl.
*A63B 53/14* (2006.01)

(52) U.S. Cl.
USPC ..... 473/302; 473/303

(58) Field of Classification Search
USPC ..... 473/300–303
See application file for complete search history.

(56) References Cited

U.S. PATENT DOCUMENTS

| | | | | |
|---|---|---|---|---|
| 5,261,665 | A | 11/1993 | Downey | |
| 5,322,290 | A * | 6/1994 | Minami | 473/201 |
| 6,372,323 | B1 * | 4/2002 | Kobe et al. | 428/119 |
| 6,723,006 | B1 * | 4/2004 | Lin | 473/300 |
| 7,160,202 | B2 * | 1/2007 | Chen | 473/300 |
| 2003/0045370 | A1 * | 3/2003 | Jaw | 473/302 |
| 2008/0102974 | A1 * | 5/2008 | Nam et al. | 473/300 |

* cited by examiner

*Primary Examiner* — Stephen L. Blau
(74) *Attorney, Agent, or Firm* — Fay Sharpe LLP

(57) ABSTRACT

A flexible golf club grip having a brightly colored underlist of elastomeric material of a certain durometer and an outer layer of less durometer. The outer layer may have voids to expose portions of the underlist or the underlist may have portions thereof extend into the voids during molding but remain recessed below the surface of the outer layer. In another version, a brightly colored cover layer is molded over the underlist and a spiral wrapped strip of softer elastomer is molded thereover with the edges of the strip spaced to expose the original strip of the cover layer.

3 Claims, 6 Drawing Sheets

FLEXIBLE GOLF CLUB GRIP

This application is a Continuation of U.S. application Ser. No. 13/246,100, which was filed on Sep. 27, 2011, by Gill et al., is entitled "FLEXIBLE GOLF CLUB GRIP" and is incorporated herein by reference in its entirety.

BACKGROUND

The present invention disclosure describes a flexible golf club grip formed with an underlist or inner core layer of elastomeric material and an outer layer of elastomeric having a softer "feel" or lesser durometer hardness. Heretofore, this softer feel has been achieved by wrapping a layer of lower durometer elastomer over the underlist either in a spiral strip after molding and adhesively securing the strip or by molding with the underlist or by over molding a separate layer. Both of these techniques have resulted in increased complexity of molding and increased cost for the grip.

It has thus been desired to find a way or means for providing the flexible golf club grip with a softer feel to the user on the outer gripping surface has yet to provide sufficient structural stability and retention of the grip on the golf club shaft. Where the outer layer of the flexible golf club grip has been formed by wrapping a spiral layer, it has been necessary to form the wrap of the same material as the underlist in order that the outer layer will be properly cured and bonded with the underlist during molding which results in the outer surface having an undesirable hardness and resulting in poor gripability.

If the outer wrapped layer such as a spiral wrap and the underlist are made of the same elastomeric material having the desired softness for the outer layer than the result is the underlist is too soft to function properly as the grip for the golf club.

It is also desired to provide decorative features and designs as visible from the exterior of the grip to provide for identification, design appeal, and thus improved marketability.

Furthermore, where a spiral wrap appearance is desired on the grip, it has been necessary to paint the spiral edges of the outer layer wrap after molding in order to achieve the desired appearance which has resulted in additional complexity and cost for the grip.

SUMMARY

The present disclosure describes a flexible golf club grip molded of elastomeric material having an underlist or inner layer of material of a desired stiffness or durometer and an outer layer or cover formed of molded elastomeric material of a significantly lesser durometer to provide softness for the desired feel and gripability to user of the golf club grip. The outer layer may be provided with voids formed in it to give a design or pattern rendering the surface of the underlist readily visible through the voids because of the relative thinness of the outer layer. If the underlist is formed of a different color than the material of outer layer a desirable design effect can easily be created without the need for any after molding operations. In another version of flexible golf club grip of the present disclosure, the underlist is molded to have portions extending outwardly through the voids provided in the outer layer to give the surface of the outer layer a design or pattern which is flush with the outer surface and thus no voids are apparent from the exterior of the grip. The underlist and outer layer may be formed of different combinations of colors thus giving the wide variety of visual effects which may be achieved without additional complexity of costs to the molding operation. In the present practice of the flexible golf club grip described therein, the underlist has the hardness in the range of about 50-80 on the Shore A scale and the outer layer has a durometer in the range of about 25-45 on the Shore A scale. In another version of the flexible grip of the present disclosure, the underlist is covered with a relatively thin over layer of colored softer elastomer; and, upon spiral wrap of an outer layer having the space between the edges and the spiral wrap forming a void resulting in the over layer being visible to give the appearance of a spiral stripe on the grip. The flexible grip of the present disclosure thus provides for an elastomeric outer surface forming the softer material than the other underlist giving the desired gripability yet enabling the formation of decorative designs and patterns visible or extending through voids in the outer layer which are formed during molding without any post molding operations.

DETAILED DESCRIPTION

Figure 1:
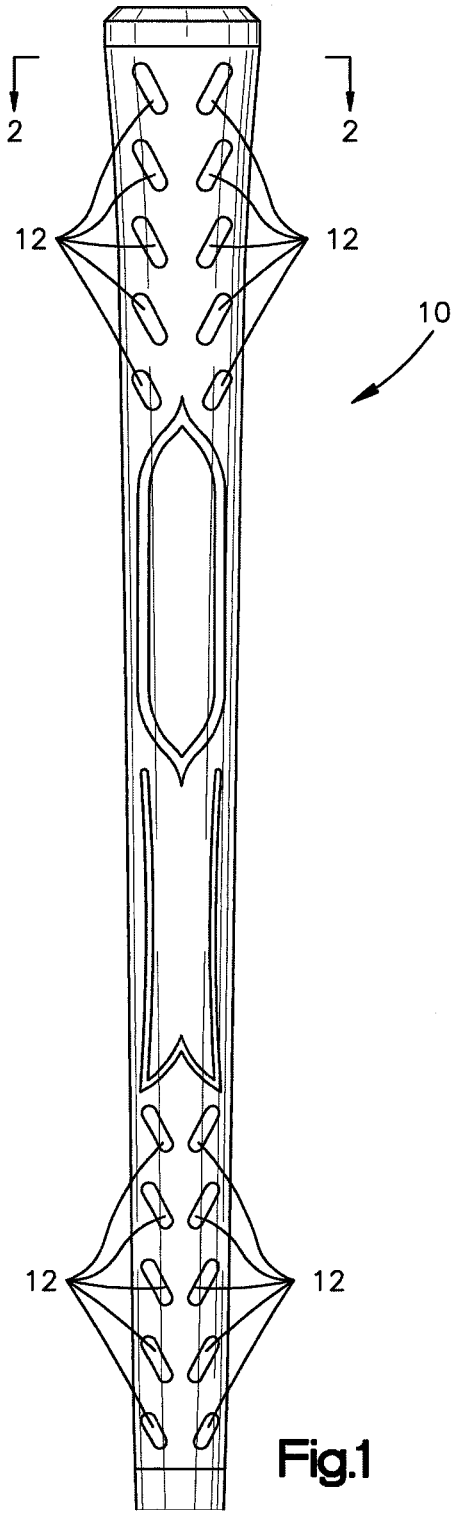
FIG. 1 is a side view of a flexible molded elastomeric golf club grip of the present disclosure.
Figure 2:
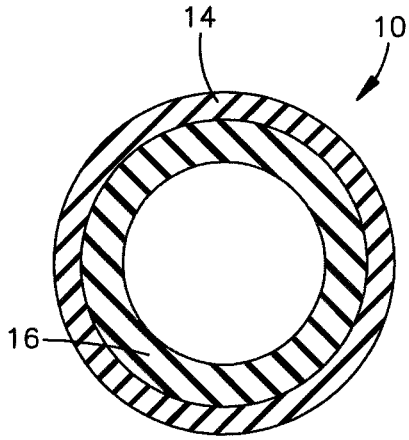
FIG. 2 is a cross-sectional view taken along section indicating lines 2-2 of FIG. 1.

Referring to FIGS. 1 and 2, a completely flexible golf club grip in accordance with the present disclosure is indicated in FIG. 1 generally at 10 and has a plurality of voids or decorative areas 12 formed in the outer surface thereof in a desired design or pattern. The voids or decorative areas are formed in an outer layer 14 molded over an underlist 16 as shown in FIG. 2. In the present practice, the underlist 16 is formed of elastomeric material having a hardness in the range of about 50-80 durometer on the Shore A scale; and, the outer layer 14 is significantly softer and has a durometer in the range of about 25-45 Shore A. The outer layer 14 may be formed of an elastomeric material having a different color than that of the underlist and is significantly thinner and may have a radial thickness in the range of about 0.8-3.2 mm.

Figure 3:
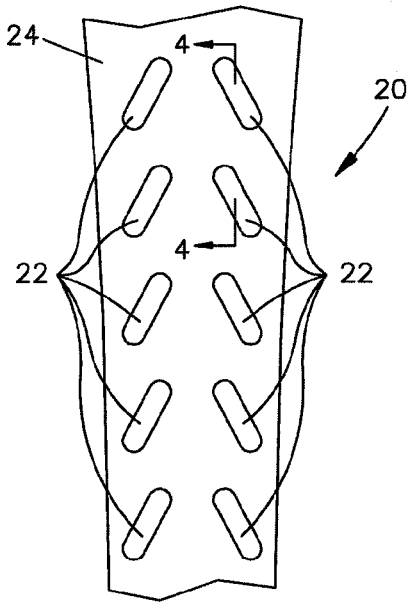
FIG. 3 is a portion of a view of one version of the grip of FIG. 1.
Figure 4:
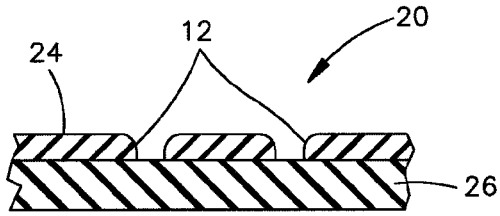
FIG. 4 is a cross-section taken along section indicating lines 4-4 of FIG. 3.

Referring to FIGS. 3 and 4, one version of the grip 10 is illustrated generally at 20 and has the voids 12 unfilled or opened such that the outer surface of the underlist 16 is visible in the open areas of the voids 12. In the arrangement of FIGS. 3 and 4, the underlist 16 may be molded of elastomer having a different color than that of the outer layer 14, thus giving the appearance of a colored design as viewed from the exterior of the grip. Because the outer layer is formed of a softer elastomeric material, the voids may provide edges giving increased gripability to the user.

Figure 5:
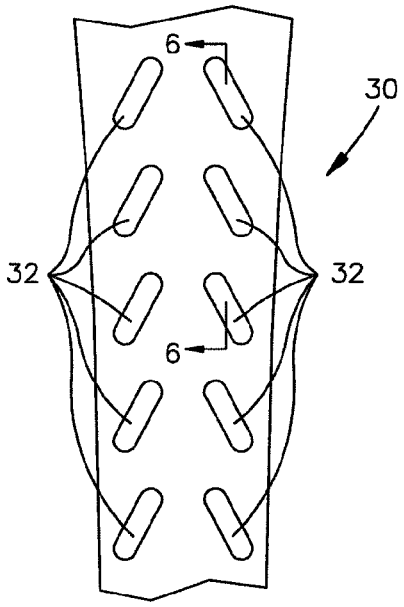
FIG. 5 is a view of a portion of another version of the grip of FIG. 1.
Figure 6:
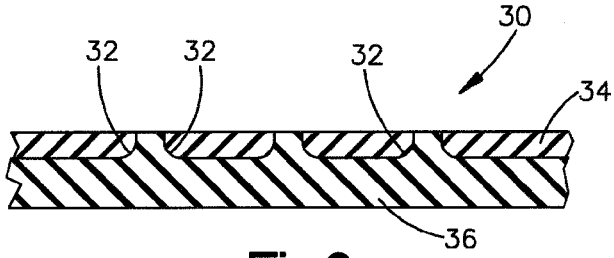
FIG. 6 is a section view taken along section indicating lines 6-6 of FIG. 5.

Referring to FIGS. 5 and 6, another version of the grip of the present disclosure is indicated generally at 30 and has the region with the decorative design formed by a pattern of voids 32 formed in the outer layer 34. The underlist 36 has portions thereof extending radially outwardly into the voids 32 and the outwardly extending portions are terminated in the mold at the outer surface of the outer layer 34 as shown in FIG. 6, thereby giving a smooth feel to the outer surface of the grip yet providing regions of softer more grippable material in the voids.

Figure 7:
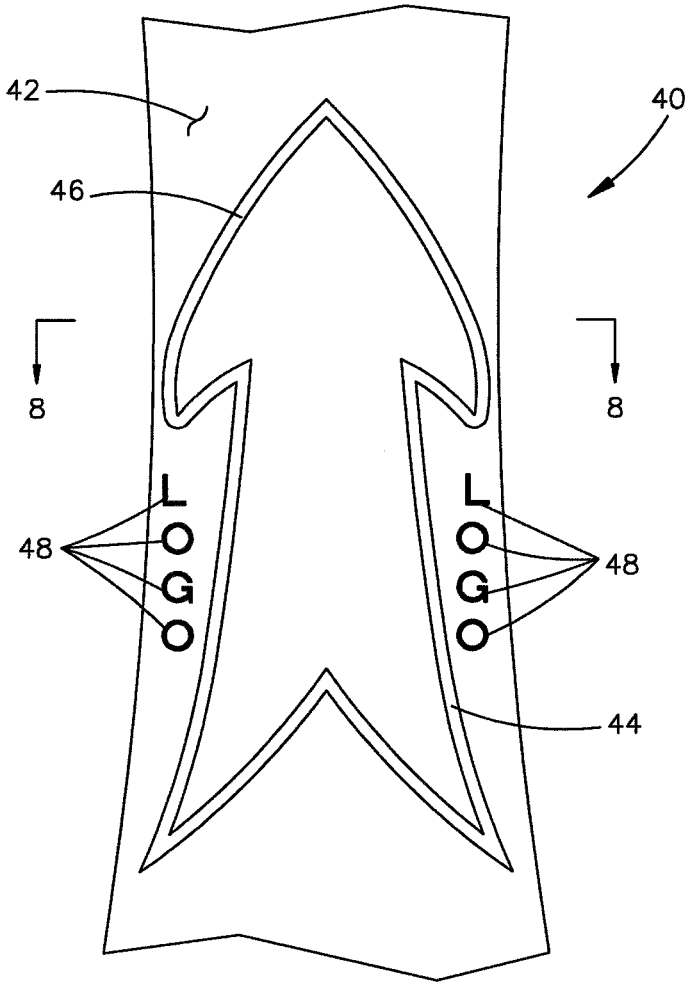
FIG. 7 is a view of a portion of another version of the grip of FIG. 1.
Figure 8:
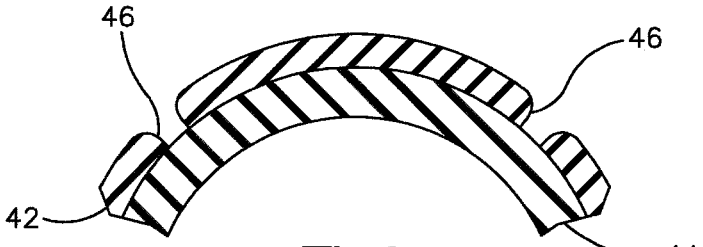
FIG. 8 is a section view taken along section indicating lines 8-8 of FIG. 7.

Referring to FIGS. 7 and 8, another version of the flexible golf club grip of the present disclosure is indicated generally at 40 and has an outer layer 42 molded of relatively softer material molded over an underlist 44. The outer layer 42 has a design or pattern in the form of a continuous void or groove 46 formed therethrough which exposes, in the region of the groove or void 46, the outer surface of the underlist 44 to provide a desired design such as, for example, the arrow design in FIG. 7. The design formed by the groove 46 may thus provide the desired decorative feature to the grip and particularly where the underlist is formed of the bright color in contrast to the color of the outer layer 42.

If desired, letters or other characters denoted by reference numeral 48 may be molded in the outer surface of the outer layer 42 and subsequently painted to provide identification or manufacturers unique indicia of origin.

Figure 9:
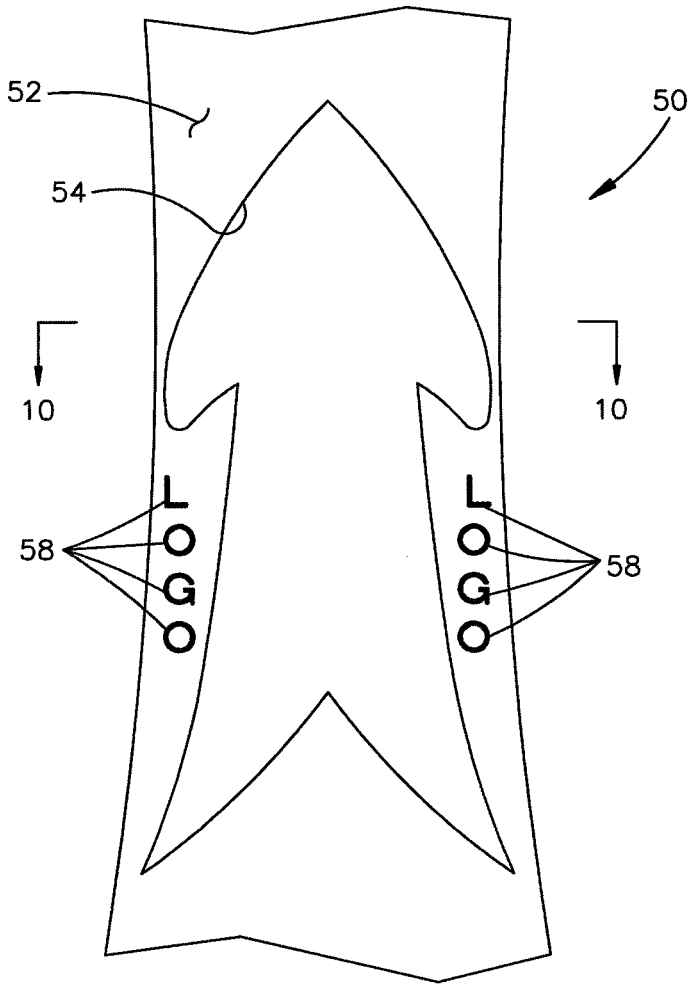
FIG. 9 is a view of a portion of another version of the grip of FIG. 1.
Figure 10:
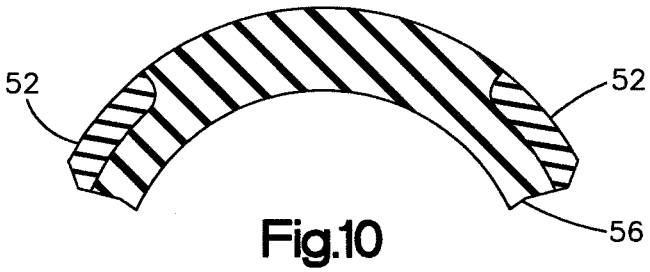
FIG. 10 is a section view taken along section indicating lines 10-10 of FIG. 9.

Referring to FIGS. 9 and 10, another version of the golf grip of the present disclosures indicated generally at 50 has an outer layer 52 formed with a substantial void or cut-out area 54 having a distinct pattern or design which is shown, by way of example in FIG. 9, as having the configuration of an arrow. The version 50 has an underlist 56 with the outer layer molded thereover and the material of the underlist is molded to have a portion thereof extend outwardly to fill the void 54 completely thereby providing the design formed by the void 54 completely of the material of the underlist which may be of a significantly different color. The version 50 of FIGS. 9 and 10 thus provides the design completely formed of the material of the underlist as compared to the outlined version of FIGS. 7 and 8.

If desired, version 50 of FIGS. 9 and 10 may have molded in the outer surface of the outer layer 52 manufacturer's indicia of origin such as the letters or characters denoted by reference numeral 58 for identification purposes; and, the characters 58 may also comprise a trademark.

Figure 11:
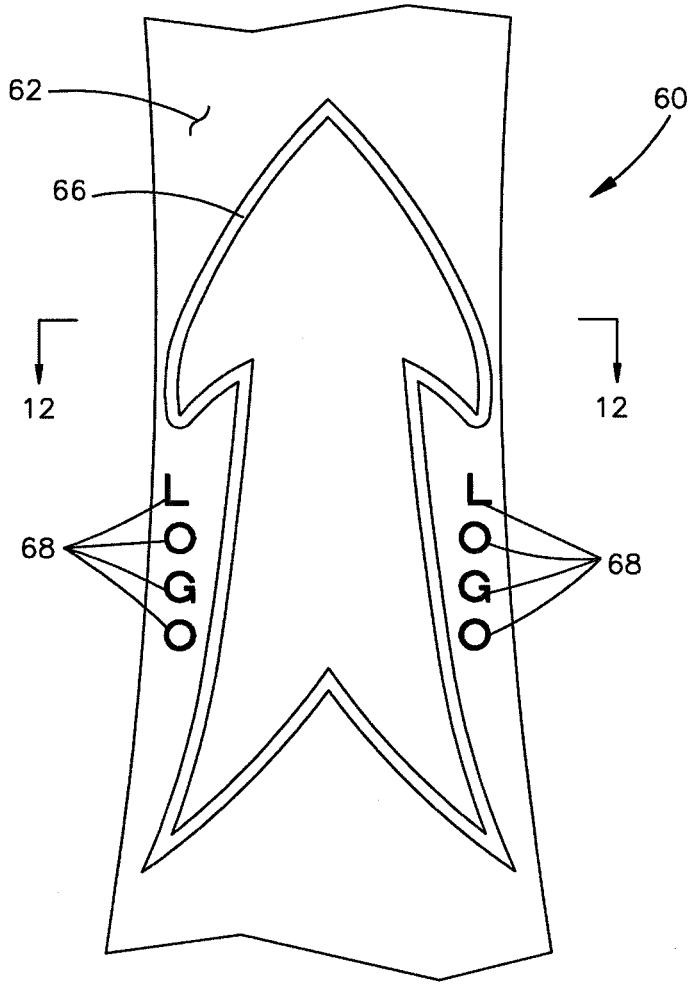
FIG. 11 is a view of a portion of another version of the grip of FIG. 1.
Figure 12:
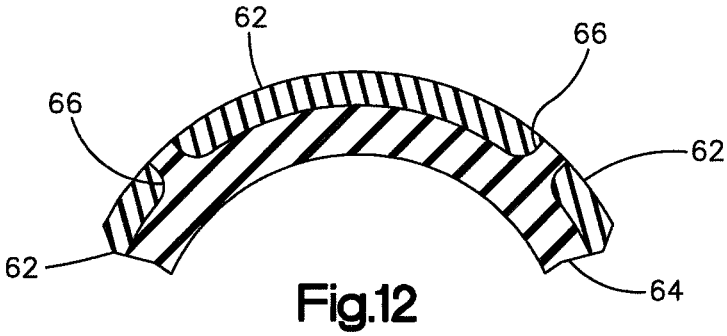
FIG. 12 is a section view taken along section indicating lines 12-12 of FIG. 11.

Referring to FIGS. 11 and 12, another version of the flexible grip of the present disclosure is indicated generally at 60 and has an outer layer 62 molded over an underlist 64, with the outer layer 62 formed of a softer or lower durometer elastomer than the underlist. In the version 60 the outer layer 62 has a continuous groove 64 formed therein as a void and which may form a distinctive design or pattern as illustrated, for example, by the arrow configuration in FIG. 11. The groove 64 is completely filled with material of the underlist 64 such material extending outwardly in the molding operation to be flush with the outer surface of the outer layer 62 as shown in FIG. 12. The version 60 thus may employ elastomer for the underlist of a significantly brighter color than that of the outer layer 62 such that the material filling the groove 64 provides an outline on the desired pattern or design and yet the outline creates a smooth surface with respect to the outer layer 62. The material of the underlist being flush with the outer surface provides not only decorative design but enhanced gripability for the user.

If desired, characters or letters such as those denoted by reference characters 68 may be molded in the outer surface of the outer layer 62 and subsequently painted and may provide indicia of origin such as a trademark.

Figure 13:
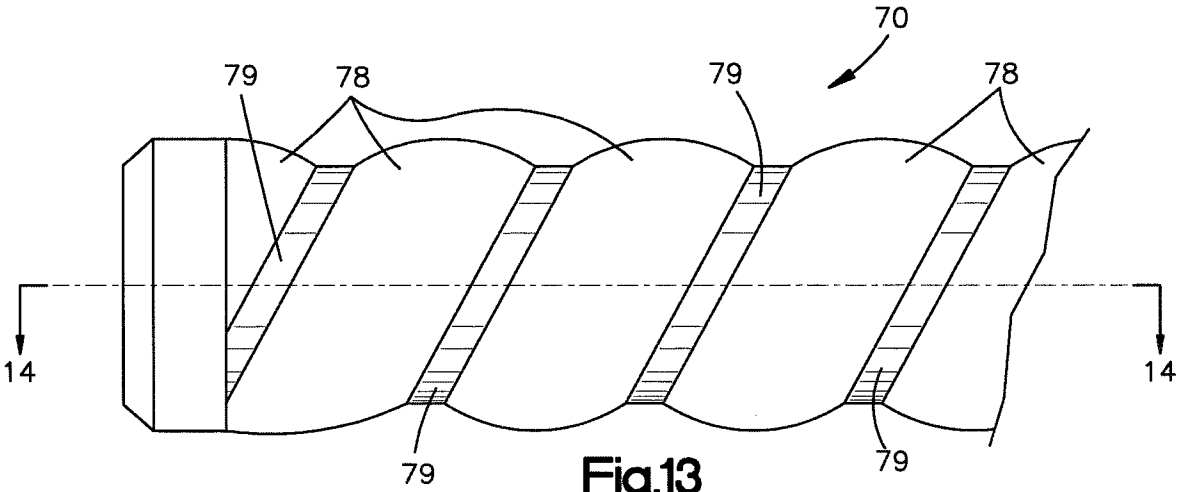
FIG. 13 is a side view of a portion of another version of the grip of the present disclosure; and, FIG. 14 is an enlarged portion of a section view taken along section indicating line 14-14 of FIG. 14.
Figure 14:
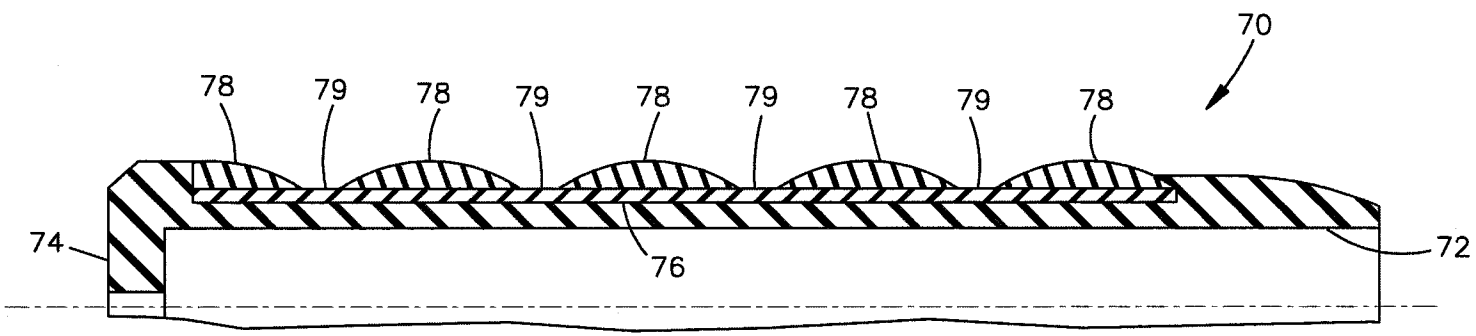

Referring to FIGS. 13 and 14, another version of the flexible golf club grip of the present disclosure is indicated generally at 70 and is of the type giving the exterior appearance of having a spirally wrapped construction which has found widespread acceptance and desirability in the marketplace. The version 70 has an underlist 72 and may have a closed end or cap 74 integrally formed therewith. The underlist 72 has a cover layer 76 molded thereover and formed of elastomer having a desired bright color for design aesthetics. An outer layer is formed by a spirally wrapped strip 78 of softer elastomeric material than the underlist. In the present practice, it has been found satisfactory to have the adjacent edges of the spirally wrapped strip separated to provide a gap having a width in the range of about 1.6-3.2 mm so as to expose a spiral strip of the outer surface of the cover layer 76 which strip is denoted by reference numeral 79 in FIGS. 13 and 14. The version 70 at FIGS. 13 and 14 thus provides the marketable spiral wrapped grip configuration with a bright color outline to the edges of the spiral wrap without the complexity and expense of post molding operations.

The present disclosure describes a flexible elastomeric golf club grip molded with an underlist and a softer outer layer having a decorative design provided by voids formed in the outer layer to expose portions of the underlist which may be brightly colored. In one version, the voids are left open and in another version the voids are filled during molding with material from the underlist extending outwardly to the outer surface of the outer layer. In another version a spirally wrapped configuration is provided by a cover layer of brightly colored elastomer molded over the underlist; and, the outer layer formed of a softer spirally wrapped elastomer with the edges of the spiral wrap spaced to expose the cover layer giving a brightly colored spiral wrapped design to the grip. The golf club grip of the present disclosure thus provides multicolored designs and increased gripability having portions of the design formed of softer elastomer and yet requires no post-molding operations to provide the colored design.

Obviously, modifications and alterations will occur to others upon reading and understanding the preceding detailed description. It is intended that the exemplary described versions be construed as including all such modifications and alterations insofar as they come within the scope of the appended claims or the equivalents thereof.

The invention claimed is:

1. A flexible golf-grip comprising:

(a) an underlist formed of molded elastomeric material having a hardness of about 50-80 durometer on the Shore A scale;

(b) an outer grippable layer of elastomeric material molded over the underlist having a hardness of about 25-45 durometer Shore A and a radial thickness of about 0.8-3.2 mm and having a different color from the underlist; and, (c) a plurality of voids formed in the outer layer during molding, wherein portions of the surface of the underlist are exposed in the voids and visible therein as a design and the exposed portions remain recessed below the surface of the outer layer, wherein edges of the voids give increased gripability to the user.

2. The grip defined in claim 1, wherein the visible portion of the surface of the underlist includes a multicolored design.

3. The grip of claim 1, wherein the plurality of voids comprise elongated slots spaced therealong and slanted with respect to the longitudinal axis of the grip.

* * * * *